US006899405B2

(12) United States Patent
Semple

(10) Patent No.: US 6,899,405 B2
(45) Date of Patent: May 31, 2005

(54) ORGANIZER FOR SHEET MATERIALS

(76) Inventor: Ava Semple, 130 Nottingham Rd., Syracuse, NY (US) 13210

( * ) Notice: Subject to any disclaimer, the term of this patent is extended or adjusted under 35 U.S.C. 154(b) by 2 days.

(21) Appl. No.: 10/614,376

(22) Filed: Jul. 7, 2003

(65) Prior Publication Data

US 2005/0006992 A1 Jan. 13, 2005

(51) Int. Cl.[7] ..... A47B 63/00
(52) U.S. Cl. ..... 312/184
(58) Field of Search ..... 312/183, 184, 312/185, 187, 189; 211/46, 94.02

(56) References Cited

U.S. PATENT DOCUMENTS

| | | | | | |
|---|---|---|---|---|---|
| 3,682,522 | A | * | 8/1972 | Splan | 312/184 |
| 3,980,360 | A | * | 9/1976 | Wright et al. | 312/184 |
| 4,530,176 | A | * | 7/1985 | Rejwan | 40/359 |
| 4,666,047 | A | * | 5/1987 | Fletcher | 211/46 |
| 4,717,215 | A | * | 1/1988 | Everts | 312/184 |
| 4,820,073 | A | * | 4/1989 | Thomas et al. | 402/68 |
| 5,197,791 | A | * | 3/1993 | Domenig | 312/348.1 |
| 5,199,809 | A | * | 4/1993 | Semerjian | 402/4 |
| 6,123,479 | A | * | 9/2000 | Dumke | 402/4 |
| 6,626,602 | B1 | * | 9/2003 | Yuen | 402/73 |

FOREIGN PATENT DOCUMENTS

| | | | | |
|---|---|---|---|---|
| CH | 362401 | * | 7/1962 | 312 184 |
| FR | 1024667 | * | 4/1953 | 312 184 |
| FR | 642529 | * | 5/1964 | 312 184 |
| FR | 33285 | * | 5/1977 | 312 184 |
| GB | 757030 | * | 9/1956 | 312 184 |
| GB | 815171 | * | 6/1959 | 312 184 |
| GB | 872635 | * | 7/1961 | 312 184 |

* cited by examiner

*Primary Examiner*—James O. Hansen
(74) *Attorney, Agent, or Firm*—Wall Marjama & Bilinski LLP

(57) ABSTRACT

An organizer for filing loose sheets of material in an orderly manner that includes an open top housing having a pair of opposed parallel rails extending along the length of the housing. At least one frame assembly supported upon the rails that contains hangers upon which a plurality of sheet receiving envelopes are suspended. A slide closure is mounted upon the frame which can be moved from an open position wherein the envelopes can be removed or replaced on the fasteners and a closed position wherein the envelopes are prevented from being dislodged from the frame.

7 Claims, 3 Drawing Sheets

ORGANIZER FOR SHEET MATERIALS

BACKGROUND OF THE INVENTION

This invention relates to an organizer for storing loose sheets of material such as photographs, file cards, recipe cards and the like in an orderly and safe manner.

As disclosed in U.S. Pat. Nos. 3,682,522 and 4,717,215 loose sheets of material are oftentimes placed in hanging files and the files, in turn, suspended between parallel rails in file drawers or boxes. The hanging file generally involves a long sheet of cardboard that is folded to form an inverted U-shaped container or file into which sheets of material can be inserted. Rods having hook-like appendages are secured to the opposed top ends of the folder and are used to hang the file between the rails. Depending on the size of the file drawer or box, a number of files can be suspended along the length of the rails. Although hanging files work well in practice, they oftentimes are mishandled by the user resulting in the file becoming damaged and rendered unusable. In addition, the materials stored in the files, and in particular small size paper sheets, can curl up and end up being lost or damaged in the bottom of the file.

A container for storing photographs is disclosed in U.S. Pat. No. 4,530,176. Here the photographs are placed in a series of albums and the albums are placed upon hangers and suspended upon rails located within the container. The albums, however, are rather complex and thus difficult to assemble. Each album is held together by an elastic band that is stretched around the outer periphery of the assembly. Inserting and withdrawing the albums from the container can cause the elastic bands to become worn or physically dislodged, thus allowing the albums to come apart and the contents becoming lost.

SUMMARY OF THE INVENTION

It is an object of the present invention to improve organizers for filing and storing sheet like articles.

It is a further object of the invention to provide a simple yet secure system for cataloguing and storing sheet like articles.

A still further object of the present invention is to provide an improved filing system that allows for easy removal and refiling of sheet like articles and in particular small sheets of material.

These and other objects of the present invention are attained by an open top housing having a pair of spaced apart parallel rails that extend along the length of the housing in the upper part of the housing. At least one support frame is mounted between the rails which contains a pair of hangers. A plurality of envelopes are hung from the rails and sheet like articles are stored inside each envelope. A slide closure is arranged to move over the support frame between a first open position wherein envelopes can be freely passed onto or off the hangers and a second position wherein the envelopes that are on the hangers are prevented from being removed therefrom. A latching mechanism is used to hold the slide closure in both the open and the closed positions.

BRIEF DESCRIPTION OF THE DRAWING

For a further understanding of these and other objects of the present invention, reference will be made to the following detailed description of the invention which is to be read in association with the accompanying drawings, wherein.

DETAILED DESCRIPTION OF THE INVENTION

Figure 1:
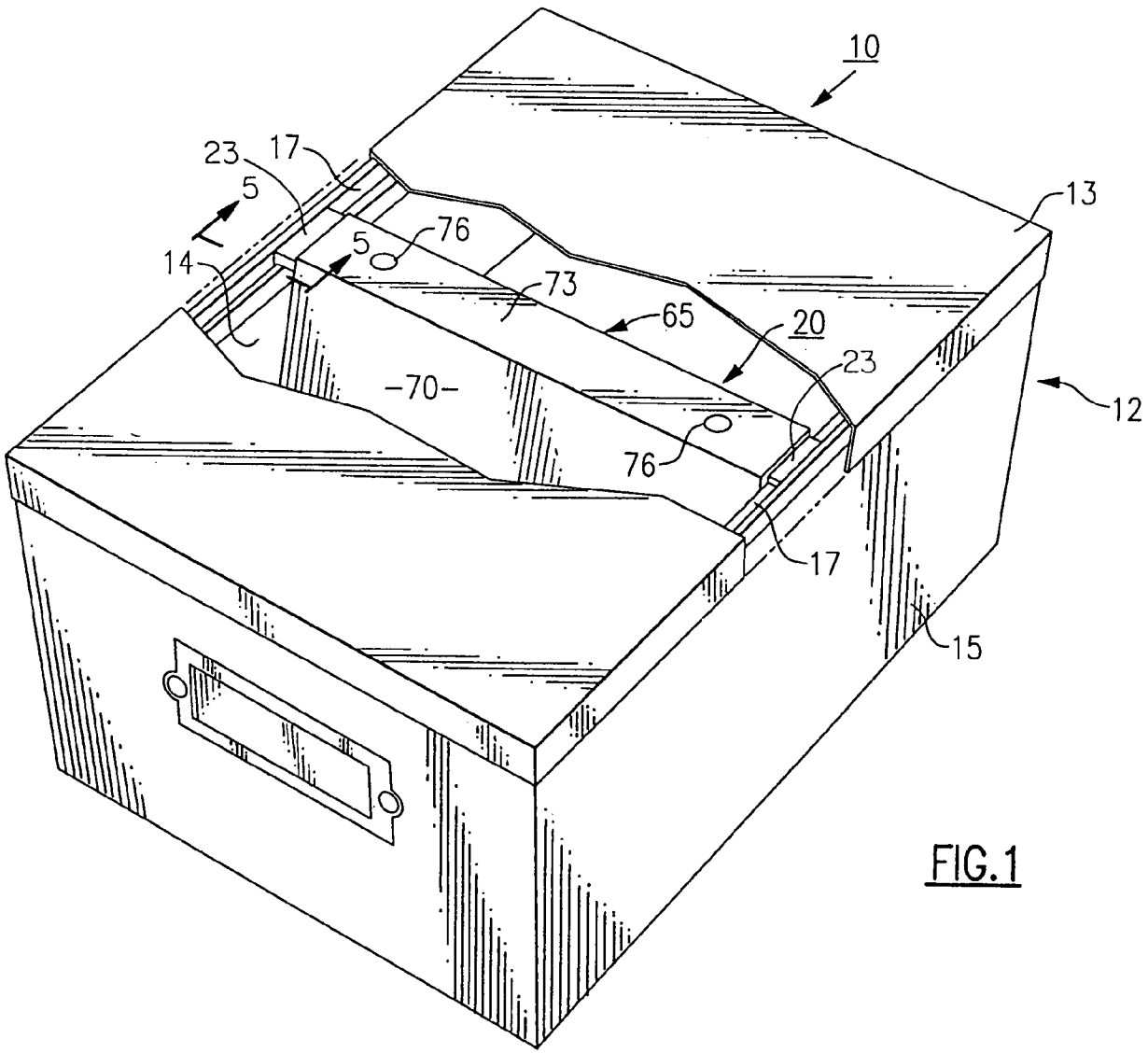
FIG. 1 is a perspective view of an organizer that encompasses the teachings of the present invention.
Figures 2, 4, 5:
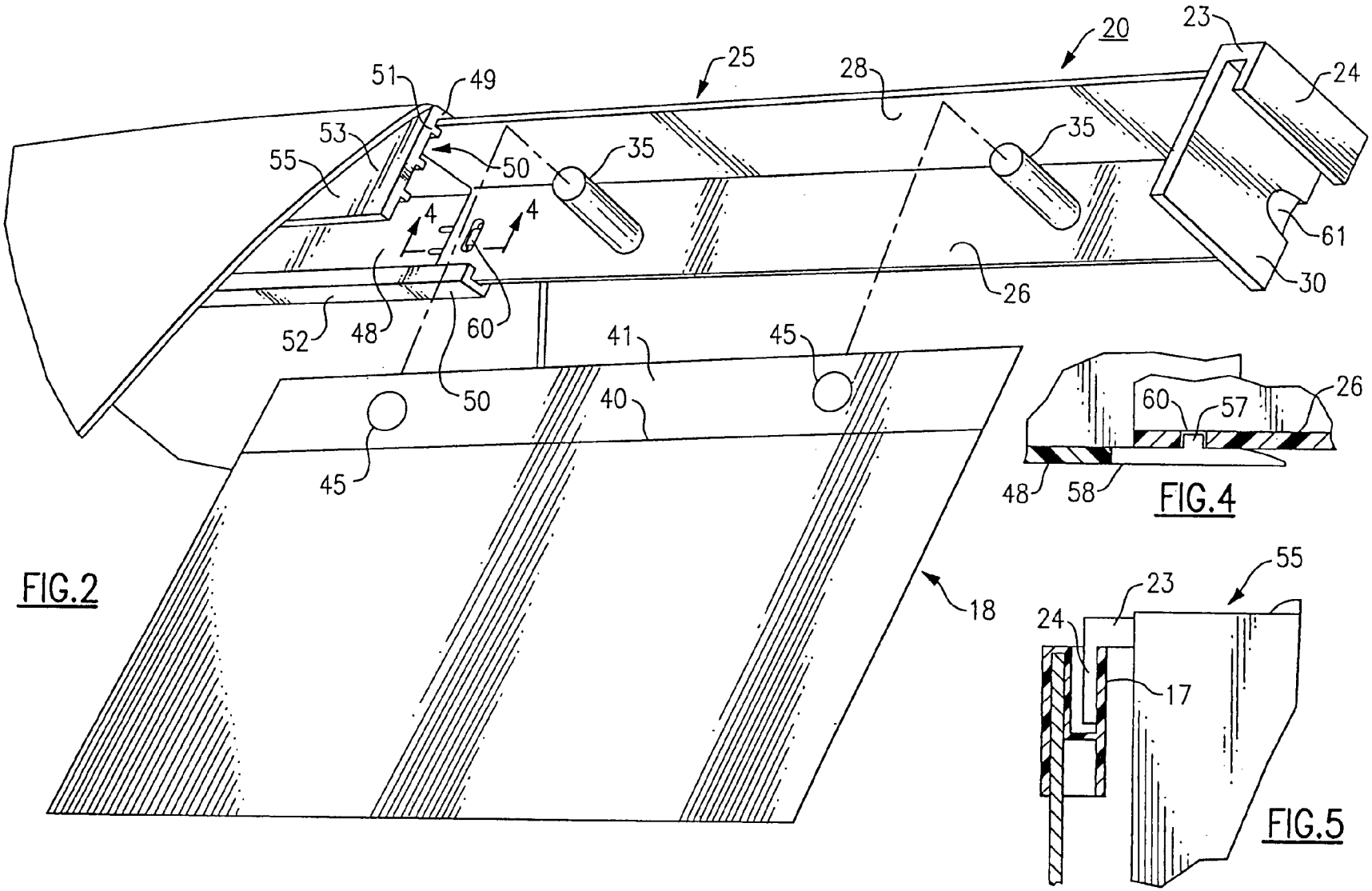
FIG. 2 is a partial enlarged perspective view of a support frame that is removably contained in the organizer illustrated in FIG. 1, showing a gate that is slidably mounted upon the frame in an open condition.
FIG. 4 is an enlarged sectional view taken along lines 4—4 in FIG. 2, further illustrating a latch for holding the gate of the frame in either an open or a closed condition.
FIG. 5 is a partial sectional view taken along lines 5—5 in FIG. 1.
Figure 3:
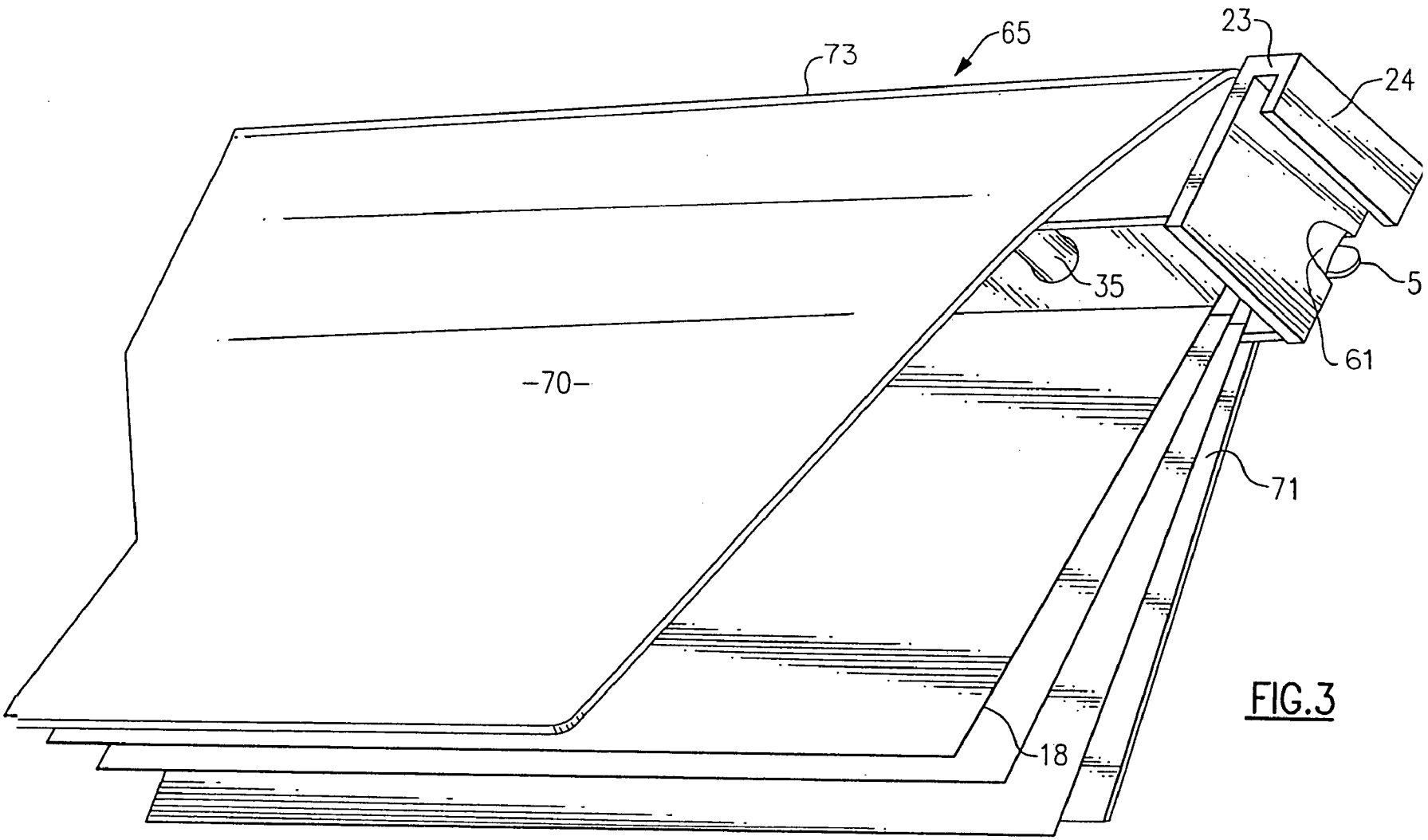
FIG. 3 is a partial perspective view similar to FIG. 2, showing the gate in a closed condition.

Turning initially to FIGS. 1–3, there is illustrated an organizer, generally referenced 10, that encompasses the teachings of the present invention. As will be explained in greater detail below, the organizer is specifically designed to store small size sheets of material in an orderly manner so that the individual sheets are not lost or displaced and can be easily and quickly retrieved when needed. Such sheets or articles may include but are not necessarily limited to photographs, file cards that contain various pieces of information, recipes and the like, checks, sales slips and other such useful data that is generally difficult to store and retrieve. The organizer includes a rectangular shaped open top housing 12 that is closed by a removable lid 13. The housing further includes a pair of vertically disposed sidewalls 14 and 15. A pair of parallel rails 17 are mounted inside the housing so that each rail extends along the length of the housing adjacent to the top rim of one of each sidewall.

A frame assembly, generally referenced 20, is shown suspended between the two rails so that envelopes 18 (FIG. 2) supported in the frame can hang down from the rails within the housing. Although only one frame assembly is illustrated in FIG. 1, it will become apparent from the description below that a number of frame assemblies can be suspended from the rails to fill the entire interior of the housing. Each frame assembly is arranged so that it can be passed into and out of the housing through its open top when the cover to the housing is removed. A pair of rest plates 23 (FIG. 2) extend outwardly from either end of the frame assembly and are arranged to rest upon the top of the two rails and thus slidably suspend the frame assembly inside the housing. A lip 24 depends downwardly from the rest plates which serve to prevent the frame from becoming canted or misaligned upon the rails.

With further reference to FIGS. 2 and 3, there is shown in greater detail one of the frame assemblies 20. The frame assembly includes a laterally disposed L-shaped support member 25 that contains a vertically disposed sidewall 26 and a horizontally disposed top wall 28. The support member further includes one end walls 30 from which one of the slide plates 23 is extended. Preferably, the top wall, the sidewall and the end wall of the frame are integrally formed of a high strength plastic material. The previously noted slide plates 23 and lip 24 are also integral joined to the end wall with the slide plate extending outwardly from the top edge of the end wall.

A pair of dowel pin hangers 35—35 are anchored at one end in the vertical sidewall of the support member so that the distal end of each dowel extends outwardly from the vertical sidewall beneath the horizontal top wall of the support member. The exposed end of each dowel pin is substantially equal in length to the inside width of the horizontal top wall 28 such that the free edge of the top wall and the distal end of the dowels lie substantially in the same vertical plane.

Each envelope 18 has a side opening and an upwardly disposed Tab 41 which is integral and coplanar with the back wall of the envelope. The Tab contains a pair of holes 45—45 formed therein that are located on the same center distance as the two dowel hangers. The diameter of each hole is slightly larger than that of the dowels so that each envelope can pass freely onto the dowel pins. The dowel pins are of sufficient length so that a number of envelopes can be hung from the pair. The envelopes can be fabricated from any type of suitable material, however, a relatively strong, transparent plastic is preferred for use in most applications.

The envelopes are of a size and shape such that a number of sheet like articles can be stored in each envelope. The height of each envelope is less than the depth of the housing so that the envelopes will not touch or otherwise rest upon the bottom of the housing when the envelope is suspended on the dowels.

A C-shaped slide member 55 (FIG. 2) encircles the L-shaped support member so that the two members can be telescoped one inside the other in assembly. The slide member contains channel shaped appendages 50 and 51 for slidably accepting the two edges of sidewalls 26 and top wall 28 of the support member 25. The channels guide the support member within the slide member as the support member moves between a first open position as illustrated in FIG. 2 and a fully closed position as illustrated in FIG. 1. When the slide member is placed in the open position, the dowel pins are exposed so that one or more envelopes can be hung upon the dowels. The slide member further includes a vertically disposed front wall 53 that is arranged to close over the ends of the dowel pins when the slide is brought to the closed position thereby preventing the envelopes from being dislodged from the pins.

As further illustrated in FIG. 4, a detent lug 57 is carried on the end section 58 of the backwall 48 of the slide member 55. The lug is arranged to engage a cutout 60 formed in the sidewall 26 of the support member 20 when the slide assembly is placed in the open position. Similarly, the lug is also arranged to engage a second cutout 61 formed in the endwall 30 of the support member when the slide is moved to the closed position. The slide member is preferably molded of a plastic material having sufficient resiliency to permit the lug to be released from either of the cutouts allowing the slide member to be moved from one extreme position to another.

Turning now to FIG. 5, a second rest plate 23 and lip 24 are integrally mounted as a unit at the left hand side of the slide member as viewed in FIG. 1. As explained above, the rest plate is adapted to rest upon one of the rails 17 contained within the housing. The length of the frame assembly when placed in the closed position is such that both rest plates will lie upon the opposed rails to suspend the frame in a generally horizontal position within the housing wherein the frame is in perpendicular alignment with the sidewalls of the hanger.

The length of the slide unit is about equal to that of the frame assembly. A protective sheath 65 is mounted upon the slide member which protectively encloses the envelopes when the slide unit is in a closed position. The protective sheath includes a front cover 70 and a rear cover 71 that are integrally connected by a spine 73. The spine, in turn, is attached to the top wall 49 of the slide unit by suitable fasteners such as rivets 76. The sheath is preferably fabricated of a flexible plastic which permits the front and rear covers to hang down protectively over the envelopes mounted upon the dowels when the slide unit is placed in a closed position.

While the present invention has been particularly shown and described with reference to the preferred mode as illustrated in the drawing, it will be understood by one skilled in the art that various changes in detail may be effected therein without departing from the spirit and scope of the invention as defined by the claims.

What is claimed is:

1. Apparatus for organizing loose sheets of material in an orderly manner that includes:

an open top housing that contains a pair of spaced apart parallel rails mounted in the top section of the housing;

at least one frame assembly supported upon said rails so that said frame assembly can be passed into and out of the housing through said open top;

at least one envelope to be supported by said at least one frame assembly;

said at least one frame assembly includes a hanger means mounted upon a support member for removably supporting a series of said envelopes upon said support member so that the envelopes hang down inside said housing, each said at least one envelope having a capacity to hold a number of sheets therein;

a slide member that is arranged to move over said support member between a first open position and a second closed position, said slide member further including a closure panel that closes over said hanger means when the slide member is in a closed position to prevent envelopes mounted upon said hanger means from being dislodged and for exposing said hanger means when said slide member is in an open position to permit envelopes to be removed from or placed upon said hanger means; and a latching mechanism for retaining the slide member in one of the open position and the closed position, said latching mechanism including a detent member engageable with at least one recess when said frame member is moved to one of said open and closed positions.

2. The apparatus of claim 1 wherein said hanger means includes a pair of spaced apart dowels, each dowel having one end anchored in a vertical sidewall of said support member and a free end outwardly disposed from said vertical sidewall of said support member.

3. The apparatus of claim 2 wherein the dowels are perpendicularly aligned with said sidewall.

4. The apparatus of claim 1 wherein each said envelope includes an upwardly extended tab that contains a pair of spaced apart holes for receiving said dowels therein.

5. The apparatus of claim 4 wherein each envelope is fabricated of a transparent material.

6. The apparatus of claim 1 that further includes a protective sheath that depends downwardly from the slide member to enclose said envelopes mounted in said frame when the slide member is placed in the closed position.

7. The apparatus of claim 1 wherein said frame assembly includes a rest plate that protrudes outwardly from either end of the assembly so that each rest plate rests in sliding contact with one of said rails.

* * * * *